United States Patent [19]

Brown

[11] 3,980,299

[45] Sept. 14, 1976

[54] TENNIS GAME APPARATUS KIT

[75] Inventor: Robert Leon Brown, El Cerrito, Calif.

[73] Assignee: Lawrence Peska Associates, Inc., New York, N.Y. ; a part interest

[22] Filed: Aug. 4, 1975

[21] Appl. No.: 601,805

[52] U.S. Cl. ..... 273/29 R; 273/29 B; 273/29 BA; 273/29 BB; 273/31

[51] Int. Cl.[2] ..... A63B 61/00

[58] Field of Search ..... 273/29 R, 31, 29 A, 273/29 BA, 29 BB, 29 B, 29 BC, 29 BD, 29 BE, 29 BF

[56] References Cited

UNITED STATES PATENTS

| | | | |
|---|---|---|---|
| 1,897,801 | 2/1933 | Healy | 273/31 |

FOREIGN PATENTS OR APPLICATIONS

| | | | |
|---|---|---|---|
| 11,541 | 7/1889 | United Kingdom | 273/29 BB |
| 6,056 | 4/1888 | United Kingdom | 273/29 BB |
| 18,221 | 10/1891 | United Kingdom | 273/29 BB |
| 4,079 | 3/1885 | United Kingdom | 273/29 BD |
| 318,035 | 10/1928 | United Kingdom | 273/31 |
| 207,917 | 12/1923 | United Kingdom | 273/29 BB |

*Primary Examiner*—Richard C. Pinkham
*Assistant Examiner*—T. Brown
*Attorney, Agent, or Firm*—Richard E. Nanfeldt

[57] ABSTRACT

A kit for constructing a tennis court on asphalt, concrete, or grass. The kit includes flexible tape for forming the lines of the court and a mechanism for anchoring the tape to the ground. A portable center court net assembly is provided with a mechanism for anchoring the assembly to the ground. The kit also includes portable side and end net assemblies for retaining tennis balls which are hit out of bounds. The end and side assemblies are provided with post supports, each post having a tripod base to render the net assemblies easily erected and dismantled.

1 Claim, 9 Drawing Figures

TENNIS GAME APPARATUS KIT

BACKGROUND OF THE INVENTION

U.S. Pat. Nos. 906,848; 1,224,387; and 1,534,437 have employed a plurality of net support assemblies for erecting a net for a game of ball. However, these aforementioned patents do not provide a net assembly similar to my present invention nor do they provide a means for erecting a couple portable tennis court.

SUMMARY OF THE INVENTION

My present invention relates to a unique and novel kit for erecting a portable tennis court on asphalt, concrete, grass or any other suitable playing surface.

Accordingly, it is an object of my present invention to provide tape members for forming the lines of a tennis court, wherein the tape members can be detachably anchored to the ground.

A further object of my present invention is to provide a portable center court net assembly, wherein the assembly can be detachably affixed to the ground.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
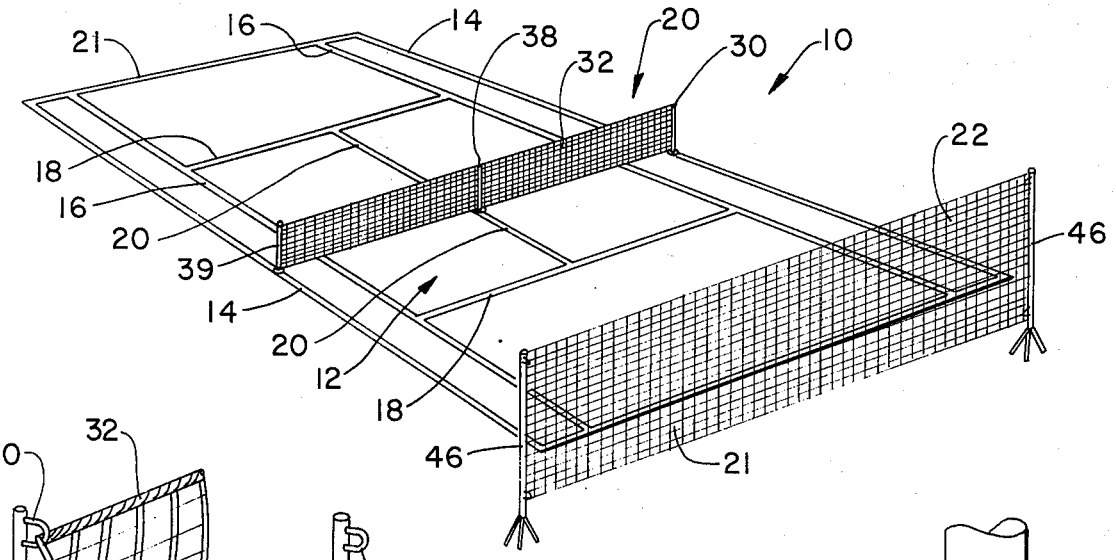
FIG. 1 illustrates a perspective view of a kit for a portable tennis court.

Turning now descriptively to the drawings, in which similar reference characters denote similar elements throughout the several views, FIG. 1 shows a kit 10 for erecting a tennis court 12 which can be readily assembled or disassembled on concrete, asphalt, or grass. The kit 10 comprises a pair of side line tapes 14, a pair of service side line tapes 16 which are parallel to tapes 14, a pair of service line tapes 18 extending between tapes 14, a half court line 20 extending between tapes 18 and a pair of end line tapes 21. A portable center court net assembly 20 is also provided. An optional end court net assembly 22 is also provided.

Figure 5:
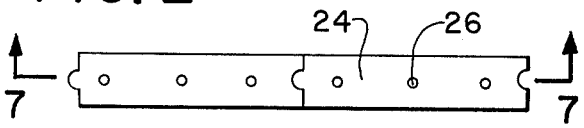
FIG. 5 illustrates a top view of an end line tape.
Figure 6:
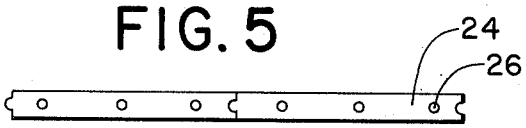
FIG. 6 illustrates a top view of a side line tape.
Figure 7:
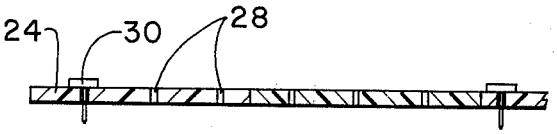
FIG. 7 illustrates a side cross sectional view of the end line tape taken along lines 7—7 of FIG. 5.
Figure 8:
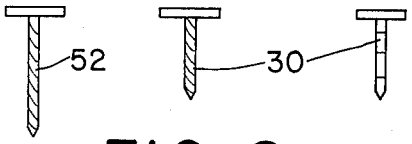
FIG. 8 illustrates a side view of the anchoring means for the tape and net assembly.

The tapes 14, 16, 18, 20, 21 consist of elongated flat members 24 having a plurality of longitudinally apertures 26 therethrough as shown in FIGS. 5, 6, 7. The tapes 14, 16, 18, 20, 21 are formed from colored flexible plastic, flexible rubber, or a cloth like material such as canvas. An ideal pigment for coloring is titanium dioxide. A plurality of anchoring members 30 such as asphalt or concrete nails are used as shown in FIG. 8, extend downwardly through the aperture 26 to secure the tapes 14, 16, 18, 20, 21 to the ground. Each tape 14 is 78 feet in length. Each tape 16 is 36 feet in length. Each tape 18 is 78 feet in length. Tape 20 is 42 feet in length.

Figure 2:
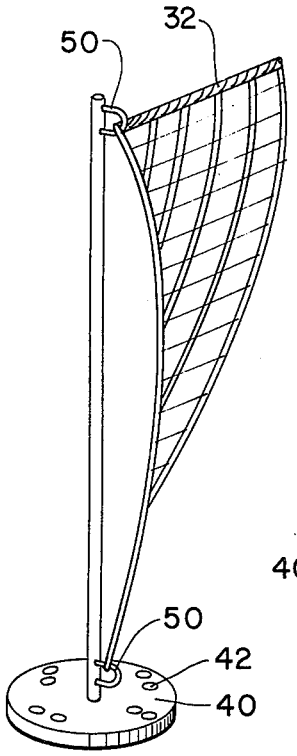
FIG. 2 illustrates a side elevation view of a net member affixed to an end pole.
Figure 3:
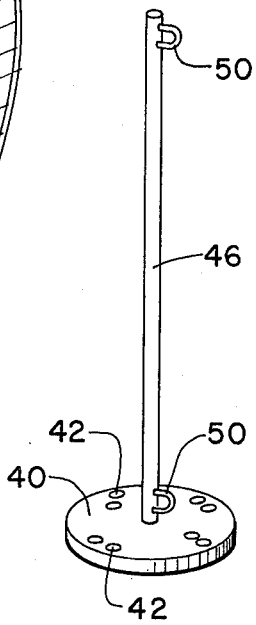
FIG. 3 illustrates a side elevation view of a center pole.
Figure 4:
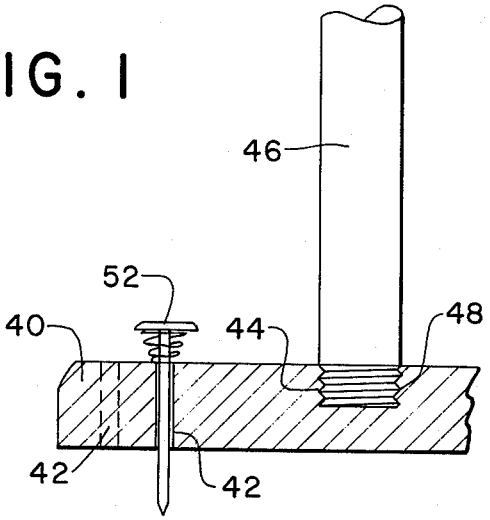
FIG. 4 illustrates a side sectional view of a pole.

The portable center court net assembly 20 as shown in Figure comprises a rectangularly shaped net member 32 which is 42 feet by 3 feet. Member 32 is affixed to two end poles 34, 36 and a center pole 38. The poles 34, 36, 38 are identical in construction, wherein each pole 34, 36, 38 as shown in FIGS. 2, 3, 4, comprises a base 40 having a plurality of holes 42 therethrough and a center top threaded opening 44 therein. An elongated cylindrically shaped rod 46 has a threaded end 48 which threadably engages into opening 44 such that rod 46 extends upwardly from base 40. A plurality of U-shaped brackets 50 are affixed onto rod 46. The net member 32 is tied onto brackets 50. A plurality of spike members 52 extend downwardly through the holes 42 so as to anchor the base 40 to the ground. The end court net assembly 22 is of the same construction as assembly 20, but for an 8 feet by 50 feet dimension. Court separating net assemblies (not shown) of an 8 feet by 90 feet dimension can also be employed. The rod 46 of assembly 20 are 42 inches in length, and the rod 46 of assembly 22 are 96 inches in length.

Figure 9:
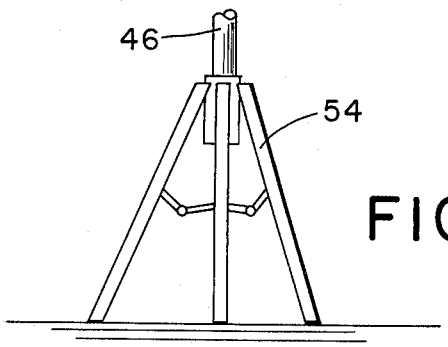
FIG. 9 illustrates a side sectional view of a second embodiment of a pole of the center court net assembly.

FIG. 9 is a net pole assembly to be used for mounting a net to separate one or more courts, or to be used in back of the end lines.

The tapes 14, 16, 18, 20 as shown in FIGS. 5, 6 can be of different widths for the end 21 and side 16 line tapes.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A kit for forming a tennis court on asphalt, concrete, or grass, which comprises:

a. a plurality of tape members for forming the sides, the ends, the service sides, and half court lines of said tennis court, each said tape member having a plurality of apertures therethrough;

b. an anchoring means extending downwardly through each said aperture to secure each said tape member to the ground;

c. a center court net assembly, said center net assembly including a pair of end poles, a center pole and a horizontally extending rectangularly shaped net member having each of its ends detachably mounting onto a said end pole and a central portion detachably attached to said center pole, each said end and center pole including a cylindrically shaped rod having one externally threaded end, a disc shaped base having a plurality of holes therethrough and a center top threaded opening therein, said threaded end of said rod threadably engaging into said threaded opening of said base, and U-shaped brackets affixed onto each said rod, said net member having means for attaching said net to said U-shaped bracket;

d. a spike extending downwardly through said holes to secure each said base to said ground;

e. a pair of end net assemblies and a pair of side line net assemblies; each said end net assembly including a net and foldable tripod poles for holding each said net in a substantially vertical plane to form a ball retaining boundary around a tennis game playing area defined by said plurality of tape members; each said pole being provided with a foldable leg tripod base.

* * * * *